US009791220B2

(12) United States Patent
Riondet et al.

(10) Patent No.: US 9,791,220 B2
(45) Date of Patent: Oct. 17, 2017

(54) DISTRIBUTION PLATE FOR A MOTOR VEHICLE HEAT EXCHANGER HEADER BOX

(71) Applicant: Valeo Systemes Thermiques, Le Mesnil Saint Denis (FR)

(72) Inventors: Christian Riondet, Bourgogne (FR); Jean-Marc Lesueur, Boult sur Suippe (FR)

(73) Assignee: VALEO SYSTEMES THERMIQUES, Le Mesnil Saint Denis (FR)

( * ) Notice: Subject to any disclaimer, the term of this patent is extended or adjusted under 35 U.S.C. 154(b) by 173 days.

(21) Appl. No.: 14/402,857

(22) PCT Filed: May 16, 2013

(86) PCT No.: PCT/EP2013/060188
§ 371 (c)(1),
(2) Date: Nov. 21, 2014

(87) PCT Pub. No.: WO2013/174721
PCT Pub. Date: Nov. 28, 2013

(65) Prior Publication Data

US 2015/0153114 A1 Jun. 4, 2015

(30) Foreign Application Priority Data

May 22, 2012 (FR) ..... 12 54665

(51) Int. Cl.
*F28F 3/12* (2006.01)
*F28F 9/02* (2006.01)

(52) U.S. Cl.
CPC ..... *F28F 3/12* (2013.01); *F28F 9/0226* (2013.01)

(58) Field of Classification Search
CPC ..... F28F 3/12; F28F 9/0224; F28F 9/0226
(Continued)

(56) References Cited

U.S. PATENT DOCUMENTS 2,073,778 A * 3/1937 Boerger ..... F28F 9/0224 165/151
4,360,060 A * 11/1982 Collgon ..... F28D 1/05333 165/173
(Continued)

FOREIGN PATENT DOCUMENTS

DE 10 2006 005 421 A1 8/2006
DE 10 2010 033 850 A1 2/2012
(Continued)

OTHER PUBLICATIONS

International Search Report for Application No. PCT/EP2013/060188 dated Jul. 4, 2013, 7 pages.
(Continued)

*Primary Examiner* — Tho V Duong
(74) *Attorney, Agent, or Firm* — Howard & Howard Attorneys PLLC

(57) ABSTRACT

The distribution plate has a transverse dimension and a longitudinal dimension and includes a peripheral seat for receiving sealing means arranged around the periphery of the distribution plate, a plurality of through-holes for heat exchange pipes, at least one of the holes extending only partially along the transverse dimension of the plate, and at least one local protuberance for positioning the sealing means, delimiting a portion of the seat for receiving the sealing means.

10 Claims, 1 Drawing Sheet

(58) Field of Classification Search
USPC ..... 165/173
See application file for complete search history.

(56) References Cited

U.S. PATENT DOCUMENTS

| | | | | |
|---|---|---|---|---|
| 5,816,316 | A * | 10/1998 | Hoffnung | F28F 9/0224 165/173 |
| 6,082,439 | A * | 7/2000 | Kato | F28F 9/0226 165/173 |
| 2012/0097379 | A1 | 4/2012 | Riondet et al. | |

FOREIGN PATENT DOCUMENTS

| | | | | |
|---|---|---|---|---|
| FR | 2742531 | A1 * | 6/1997 | F28F 9/0226 |
| FR | 2 938 052 | A1 | 5/2012 | |
| JP | S 59-92384 | U | 6/1984 | |
| JP | S 61-101288 | U | 6/1986 | |
| JP | H 06-142973 | A | 5/1994 | |

OTHER PUBLICATIONS

English language abstract and machine-assisted English translation for DE 10 2006 005 421 extracted from espacenet.com database on Dec. 11, 2014, 23 pages.

English language abstract and machine-assisted English translation for DE 10 2010 033 850 extracted from espacenet.com database on Dec. 11, 2014, 13 pages.

Machine-Assisted English language abstract for FR 2 938 052 extracted from espacenet.com database on Dec. 11, 2014, 1 page.

English language translation of Claim 1 for JPS 59-92384 provided by Morningside Translations on Jan. 5, 2015, 1 page.

English language translation of Claims for JPS 61-101288 provided by Morningside Translations on Jan. 5, 2015, 1 page.

English language abstract and machine-assisted English translation for JPH 06-142973 extracted from the PAJ database on Dec. 11, 2014, 17 pages.

* cited by examiner

DISTRIBUTION PLATE FOR A MOTOR VEHICLE HEAT EXCHANGER HEADER BOX

CROSS-REFERENCE TO RELATED APPLICATIONS

This application is the National Stage of International Patent Application No. PCT/EP2013/060188, filed on May 16, 2013, which claims priority to and all the advantages of French Patent Application No. FR 12/54665, filed on May 22, 2012, the content of which is incorporated herein by reference.

More specifically, the invention relates to a distribution plate for a header box of a heat exchanger, such as a radiator or a turbocharger exchanger. In general, a heat exchanger includes a bundle of pipes and two header boxes at either end of the pipes, each header box having a distribution plate to receive the pipes and a cover attached to the plate. It is understood that the link between the cover and the distribution plate must be sealed, and for this reason a gasket is interposed between these two parts.

BACKGROUND

In general, the distribution plate includes a peripheral groove formed by a stamped protuberant portion, which has holes to receive the heat pipes and is known as the "medallion". This groove extends continuously around the entire periphery of the plate, and it enables the gasket to be seated and positioned before replacing the cover. However, such a peripheral groove does not always extend continuously around the periphery of the distribution plate. For example, a distribution plate with a peripheral groove that is interrupted at the longitudinal ends of the distribution plate is known from document FR2938052 A1. In these end zones in which the groove is interrupted, the gasket is then positioned directly on the end pipes.

The dimensions of the heat pipes may vary from vehicle to vehicle, and consequently the configuration of the distribution plates varies. However, it is desirable for the distribution plate to have a generally identical form regardless of the size of the pipes, so that the configuration of the header boxes on the vehicles can be standardized as much as possible, for example using a standard cover placed on the plate. In the aforementioned prior art, the end pipes enable the gasket to be held in place since the length of these pipes is similar to the transverse dimension of the plate. The present invention addresses a particular need relating to a distribution plate that has end pipes that are too short to hold the gasket against the edges of the distribution plate.

Consequently, the present invention is in particular intended to propose a distribution plate that enables the positioning of a gasket even with pipes that are smaller than the cover.

SUMMARY OF THE INVENTION

For this purpose, the invention relates to a distribution plate for a header box of a motor-vehicle heat exchanger, the plate having a transverse dimension and a longitudinal dimension, and including: a peripheral seat for receiving sealing means, located around the periphery of the distribution plate; a plurality of through-holes for heat exchange pipes, at least one of the holes extending only partially along the transverse dimension of the plate; the plate also having at least one local protuberance for positioning the sealing means, delimiting a portion of the seat for receiving the sealing means.

Accordingly, it is proposed to form a local protuberance to ensure the positioning and placement of the sealing means, which is particularly useful for distribution plates that do not have a continuous peripheral groove and that have end through-holes for pipes, the length of which does not match the width of the plate. This enables the gasket to be positioned and facilitates the placement thereof. Furthermore, a standard cover can be used regardless of the width of the pipes.

"Local protuberance" means a projection attached to or integral with the distribution plate that does not extend from one end to the other of a transverse or longitudinal side of the plate. Specifically, the local protuberance is distinct from a continuous peripheral groove. Moreover, "hole extending only partially along the transverse dimension of the plate" means a through-hole for a pipe that does not extend sufficiently transversally to enable the sealing means to be positioned before the cover is placed on the plate. In other words, such a hole does not extend from one longitudinal edge to the other of the receiving seat of the sealing means, but only extends over a portion of this distance.

In general, through-holes for pipes have an oblong section and they all extend parallel to one another across the transverse direction of the plate. Furthermore, the sealing means are generally a gasket with a closed outline that is intended to seal the cover/distribution plate join, in particular to make it airtight.

The plate as defined above may also have one or more of the following features, taken individually or in combination.

- The local protuberance is located in line with a through-hole for pipes that extends only partially along the transverse dimension of the plate. This protuberance compensates for the size reduction of the pipe used.
- Said local protuberance is placed at one longitudinal end of the plate.
- The peripheral seat for receiving the sealing means is delimited by the local protuberance and by a groove delimited by a protuberant portion containing most of the through-holes for heat exchange pipes. This protuberant portion is a central flat portion emerging from the groove, that is usually stamped, and that can be referred to as the "medallion".
- The plate has at least two local protuberances arranged on either side of a hole extending only partially along the transverse dimension of the plate.
- The plate has two end holes arranged at the two longitudinal ends of the plate, the plate having a local protuberance next to each of the end holes. The plate may have two local protuberances next to each of the end holes.
- The plate includes a protuberant portion containing most of the through-holes for heat exchange pipes and a portion set back in relation to the protuberant portion, the local protuberance being formed on the set-back portion. This set-back portion has the advantage of facilitating the stamping of the distribution plate. Furthermore, the set-back portion preferably has one or more through-holes for pipes, such that the holes can be very close to the longitudinal end of the plate. Furthermore, this set-back portion facilitates assembly of the sealing means on the distribution plate.
- The set-back portion includes an inclined plane located between the protuberant portion and the longitudinal ends of the plate.

The local protuberance is formed by stamping the plate.

The local protuberance is located in at least one peripheral corner of the distribution plate.

The local protuberance has a substantially vertical wall that holds the sealing means on the plate, in particular before the cover is placed on the plate. The local protuberance is for example in the form of a boss with one flat wall.

The invention also relates to a header box of a heat exchanger having a distribution plate as set out above, a cover attached to the plate and sealing means, the sealing means being held between the cover and the local positioning protuberance.

BRIEF DESCRIPTION OF THE DRAWINGS

The invention can be better understood from the description given below, provided exclusively as an example, with reference to the drawings, in which.

DETAILED DESCRIPTION

Figure 1:
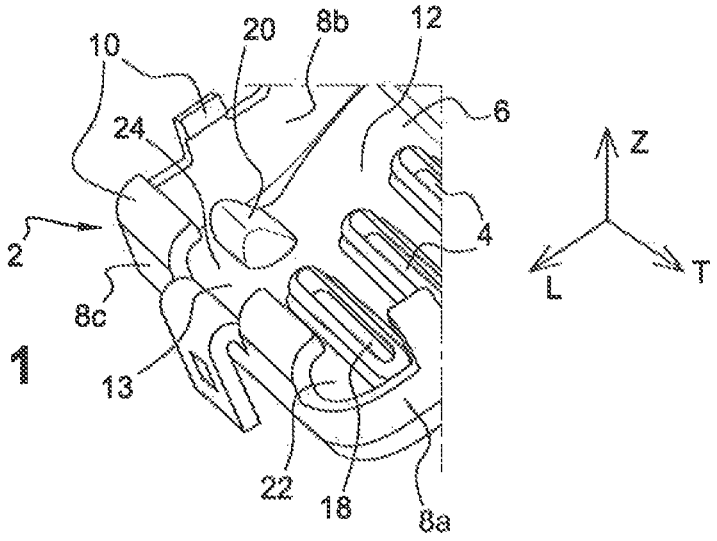
FIG. 1 is a partial perspective view of a distribution plate according to one embodiment.

FIG. 1 shows a distribution plate 2 for a header box of a heat exchanger. This heat exchanger is used in a motor vehicle, and is for example a radiator or a turbocharger air heat exchanger. The header box is placed at the end of a plurality of heat pipes that are part of the exchanger. This header box includes a distribution plate 2, a cover 25 crimped to the distribution plate 2, and sealing means 17 placed between the plate 2 and the cover 25.

The distribution plate 2 usually has a substantially rectangular shape, defining a transverse dimension T and a longitudinal dimension L. It is delimited by longitudinal edges 8*a*, 8*b* and transverse edges, of which only one edge 8*c* is shown in FIG. 1. The plate has crimping teeth 10 located on the edges 8*a*, 8*b*, 8*c* of the plate, for assembly of same with the cover 25. The distribution plate 2 also has a plurality of through-holes 4 for heat exchange pipes. The holes 4 are elongated, and they have an elongated oblong section extending along the transverse direction T of the plate 2.

In this example, each of the holes 4 extends only partially along the transverse dimension T of the plate 2, and they are positioned off center on the plate 2 along the transverse direction T. Indeed, the holes 4 are distributed along one longitudinal edge 8*a* of the plate 2 and do not reach the opposing longitudinal edge 8*b* since they are designed to receive pipes that are smaller than other pipes received by a distribution plate similar to plate 2.

In this example, the distribution plate 2 is substantially symmetrical about the transverse central axis thereof and includes a protuberant portion 6, also referred to as the "medallion", which contains most of the through-holes 4 for heat exchange pipes. The height of the protuberant portion 6 is substantially equivalent to the height of the longitudinal edges 8*a*, 8*b* of the plate. This protuberant portion 6 is formed by stamping the plate. Two inclined planes 12 extend longitudinally on either side of this protuberant portion 6, and the bottom of each inclined plane 12 extends into a horizontal flat portion referred to as the end zone 13. In this example, each inclined plane 12 has two holes 4 and each end zone 13 has one hole 18, referred to as the end hole (however, it could have several holes). Each inclined plane 12 forms with the end zone 13 a "set-back" portion that is set back in relation to the protuberant portion 6 and which extends from this portion 6 to the transverse edges 8*c* of the plate 2.

Furthermore, the distribution plate 2 has a local protuberance 20 for positioning the sealing means 17. In this example, the plate 2 has two local protuberances 20 (of which only one is shown in the figures), each one being placed in line with the end holes 18 along the transverse direction T. In other words, each local protuberance 20 is located in a peripheral corner of the distribution plate 2. The local protuberance 20 is formed by stamping the plate 2. Each local protuberance 20 has a substantially vertical wall 21 that can be used as a bearing surface for the sealing means 17 to hold same on the plate 2, as described below.

Figure 2:
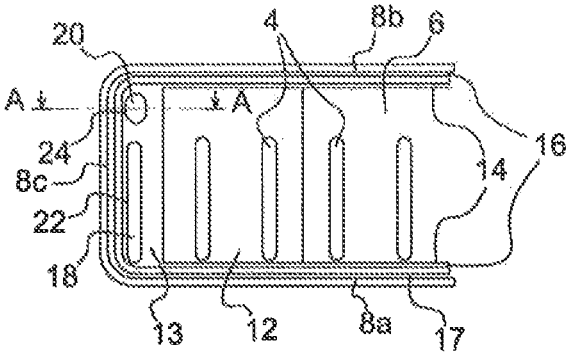
FIG. 2 is a schematic top view of the distribution plate in FIG. 1 fitted with sealing means.

As shown in FIG. 2, the protuberant portion 6 is delimited by longitudinal edges 14 that are vertical and parallel to the longitudinal edges 8*a*, 8*b* of the plate. Longitudinal grooves 16 are therefore delimited by the longitudinal edges 14 of the protuberant portion 6 and by the longitudinal edges 8*a*, 8*b* of the plate 2. These longitudinal grooves 16 delimit two longitudinal portions of a peripheral seat for receiving sealing means 17 arranged on the periphery of the distribution plate 2. More specifically, the sealing means 17 are a gasket with a closed outline of substantially rectangular shape, similar to the shape of the periphery of the plate 2. The longitudinal grooves 16 are able to receive the long sides of the sealing means 17. The peripheral seat for receiving the sealing means 17 also includes two transverse portions located at either longitudinal end of the distribution plate 2. These transverse portions of the seat include a first transverse portion 22 delimited by the end hole 18 and the transverse edge 8*c* of the plate 2. The transverse portions of the seat also include a second portion 24 delimited by the transverse edge 8*c* of the plate and the local protuberance 20. The first and second transverse portions 22, 24 of the seat can receive a short side of the sealing means 17. Thus, it can be seen that the peripheral seat for receiving the sealing means 17 comprises primarily, in this example, two longitudinal portions delimited by the longitudinal grooves 16 and the first and second transverse portions 22, 24 arranged at each longitudinal end of the plate 2, and they are notably delimited by the transverse edges 8*c* of the plate.

It can be seen that the distribution plate 2 can advantageously be made from a strip of sheet metal, all of the operations relating to the manufacture thereof and the manufacture of the holes 4, the edges 8*a*, 8*b*, 8*c*, the local protuberances 20 and all of the shapes forming it being undertaken by stamping, cutting and/or bending and other techniques for shaping sheet metals. The local protuberance 20 may be a separate part glued or attached using any suitable means.

Figure 3:
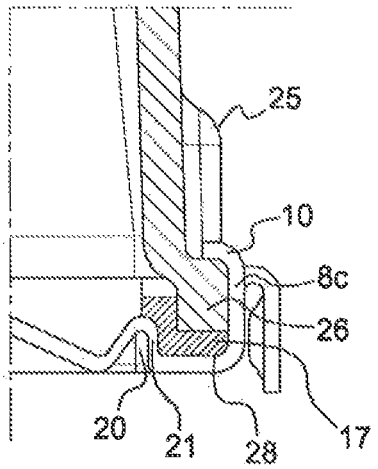
FIG. 3 is a partial cross-section along the axis A-A of the distribution plate in FIG. 2 to which a cover is attached.

The distribution plate 2 is assembled on the cover 25 as explained below, with reference to FIG. 3. Firstly, the sealing means 17 are placed in the receiving seat formed primarily by the grooves 16 and the portions 22, 24. For this purpose, the sealing means 17 are stretched and in particular butt against the vertical bearing surface 21 of the local protuberance 20 such as to hold same on the plate, in particular before the cover 25 is put in place. Once the sealing means 17 are in position, the cover 25 is put in place by pressing the edge 26 thereof into the receiving seat 16, 22, 24, above the sealing means 17. The cover 25 is then attached by crimping the teeth 10 onto the edge 26 of the cover 25. This crimping enables the sealing means 17 to be pressed against the distribution plate inside the receiving seat 16, 22, 24, thereby ensuring an airtight seal. In the example shown in FIG. 3, the seal is formed next to the crimping teeth 10 by sandwiching the edge 26 of the cover and the sealing means 17 between the teeth 10 and a zone 28 of the distribution plate 2 corresponding to the bottom of the groove delimited by the local protuberance 20 and the transverse edge 8*c*.

According to another embodiment, the end holes 18 of the distribution plate 2, or all of the holes 4, are centered along the transverse direction T of the plate 2 and a local protuberance 20 is provided on either side of each end hole 18. In other words, the distribution plate has a local protuberance 20 at each of the corners thereof.

According to an embodiment not shown, the distribution plate is flat and has no groove. The sealing means are positioned under tension on the portions of the end pipes emerging from the distribution plate and on the local protuberance or protuberances.

According to another alternative embodiment, the local protuberances are pins attached by welding, brazing, gluing, etc. onto the distribution plate or pins integral with the rest of the plate.

It can be seen that the distribution plate is particularly advantageous in that it enables sealing means 17 to be positioned without requiring the through-holes 4, 18 for the pipes extending along the entire transverse dimension of the plate, which helps to standardize configurations on vehicles.

The invention claimed is:

1. A distribution plate for a header box of a motor-vehicle heat exchanger, the plate having a transverse dimension and a longitudinal dimension and comprising:

a peripheral seat for receiving sealing means arranged around the periphery of the distribution plate, a plurality of through-holes for heat exchange pipes, at least one of the holes extending only partially along the transverse dimension of the plate, the plurality of through-holes including at least one end-hole which is positioned off-center on the plate along the transverse dimension, and at least one local protuberance for positioning the sealing means, delimiting a portion of the seat for receiving the sealing means;

wherein the at least one local protuberance is located in line in the transverse dimension with the at least one end-hole and the at least one local protuberance is placed at one longitudinal end of the plate.

2. The distribution plate as claimed in claim 1, in which the peripheral seat for receiving the sealing means is delimited by the local protuberance and by a groove delimited by a protuberant portion containing most of the through-holes for heat exchange pipes.

3. The distribution plate as claimed in claim 1, wherein the at least one local protuberance includes at least two local protuberances having a single local protuberance arranged on either side of the hole extending only partially along the transverse dimension of the plate.

4. The distribution plate as claimed in claim 3, wherein the at least one end hole includes two end holes arranged at the two longitudinal ends of the plate, the plate having one of the local protuberances next to each of the end holes.

5. The distribution plate as claimed in claim 1, including a protuberant portion containing most of the through-holes for heat exchange pipes and a portion set back in relation to the protuberant portion, the local protuberance being formed on the set-back portion.

6. The distribution plate as claimed in claim 1, in which the local protuberance is formed by stamping the plate.

7. The distribution plate as claimed in claim 1, in which the local protuberance is located in at least one peripheral corner of the distribution plate.

8. The distribution plate as claimed in claim 1, in which the local protuberance has a substantially vertical wall that holds the sealing means on the plate, in particular before a cover is placed on the plate.

9. A header box of a heat exchanger having a distribution plate as claimed in claim 1, a cover attached to the plate and sealing means, the sealing means being held between the cover and the at least one local protuberance.

10. The distribution plate as claimed in claim 5, wherein the set-back portion has an inclined plane.

* * * * *